US007373689B2

(12) United States Patent
Bowden et al.

(10) Patent No.: US 7,373,689 B2
(45) Date of Patent: May 20, 2008

(54) FLOOR CARE APPARATUS HAVING VISUAL DIRT INDICATOR WITH FLEXIBLE MEMBRANE CIRCUIT

(75) Inventors: Jason D. Bowden, Danville, KY (US); Gary P. Charbonneau, Danville, KY (US)

(73) Assignee: Panasonic Corporation of North America, Secaucus, NJ (US)

( * ) Notice: Subject to any disclaimer, the term of this patent is extended or adjusted under 35 U.S.C. 154(b) by 101 days.

(21) Appl. No.: 11/409,289

(22) Filed: Apr. 21, 2006

(65) Prior Publication Data

US 2007/0245510 A1 Oct. 25, 2007

(51) Int. Cl.
*A47L 5/00* (2006.01)

(52) U.S. Cl. ..... 15/319

(58) Field of Classification Search ..... 15/319, 15/339

See application file for complete search history.

(56) References Cited

U.S. PATENT DOCUMENTS 3,674,316 A * 7/1972 De Brey ..... 406/35
6,619,786 B2 9/2003 Cobb et al.
7,130,780 B2 * 10/2006 Yankielun et al. ..... 703/6
7,183,147 B2 * 2/2007 Murakami et al. ..... 438/164
2002/0088277 A1 * 7/2002 Schoess et al. ..... 73/170.11
2004/0194300 A1 * 10/2004 Schoess et al. ..... 29/832
2004/0226129 A1 * 11/2004 Nakamoto et al. ..... 15/352

OTHER PUBLICATIONS

Membrane Switch Technologies, Inc. "Membrane Switch Definition—5 Conditions", http://www.membraneswitchtech.com/switch.htm, printed Jun. 12, 2006, pp. 1-2.
Membrane Switch Technologies, Inc. "Membrane Switch Definition—5 Layers", http://www.membraneswitchtech.com/layers.htm, printed Jun. 12, 2006, pp. 1-6.
Membrane Switch Technologies, Inc. "Construct a Switch", http://www.membraneswitchtech.com/construct.htm, printed Jun. 12, 2006, pp. 1-3.
Membrane Switch Technologies, Inc. "Membrane Switch Specifications", http://www.membraneswitchtech.com/specs.htm, printed Jun. 12, 2006, pp. 1-2.
JST Mfg, Co., Ltd. "FDZ Connector", http://www.jst-mfg.com/pdfE/eFDZ.pdf, printed Jun. 12, 2006, p. 421.

* cited by examiner

*Primary Examiner*—David B Thomas
(74) *Attorney, Agent, or Firm*—King & Schickli, PLLC

(57) ABSTRACT

A floor care apparatus has a housing with a wall having a contour. A flexible membrane circuit includes an adhesive side that attaches the circuit to the wall to generally follow the contour. A controller connects to the circuit and illuminates a visual indicator as a relative function of the cleanliness or dirtiness of a signal of a dirt sensor connected to the controller. A motor is also controlled by the controller as a relative function of the dirt sensor signal. Further, the flexible membrane circuit includes a side opposite the adhesive side to friction fit the visual indicator against the housing. Preferably, the visual indicator includes a plurality of colors, from light emitting diodes, wherein the side opposite the adhesive side of the circuit connects to the light emitting diodes.

20 Claims, 7 Drawing Sheets

FLOOR CARE APPARATUS HAVING VISUAL DIRT INDICATOR WITH FLEXIBLE MEMBRANE CIRCUIT

TECHNICAL FIELD

The present invention relates generally to the floor care field. More particularly, it relates to a floor care apparatus, such as a canister or upright vacuum cleaner, having a visual indicator for users and an arrangement therefor. The arrangement relates to a flexible membrane circuit and/or a controller illuminating the indicator based upon detected dirt and dust flow in the cleaner.

BACKGROUND OF THE INVENTION

Whether canister or upright, vacuum cleaners in all of their designs and permutations have become increasingly popular over the years. In general, they incorporate a suction fan motor, attendant dirt cup or dust bag and a nozzle assembly fluidly and mechanically connected to one another that suck up dirt and dust during operator movement across a dirt-laden floor. Specifically, an agitator within the nozzle assembly rotates to beat the nap of a carpet and dislodge dirt and dust during a time when an operator manipulates the cleaner back and forth. Dirt and dust then enters the cleaner and flow in an airstream toward the motor. Often times, visual indicators are provided to show operators a relative cleanliness or dirtiness of the airstream. If clean, the operators can then manipulate the cleaner in other areas.

While useful, the visual indicators typically require manufacturing complexity. That is, they regularly require indicators or lights, dedicated printed circuit boards (PCB's) and a variety of fasteners for securing to a cleaner housing. Some even require peculiar functionality in mechanically securing wire bundles to various contours of the housing and spacing to accommodate the bulk of the PCB. In this regard, dedicated parts and peculiarity adds economic and manufacturing costs.

Accordingly, the floor care arts have need of simple, yet effective, visual indicators and arrangements therefor. Naturally, any improvements should further contemplate good engineering practices, such as relative inexpensiveness, ease of manufacturing, low complexity, etc.

SUMMARY OF THE INVENTION

In accordance with the purposes of the present invention as described herein, an improved floor care apparatus is provided. The apparatus may take the form of a canister or an upright vacuum cleaner or may embody an extraction cleaning device or other hereinafter developed product having a visual indicator to indicate a relative cleanliness or dirtiness of an airstream being cleaned.

In one embodiment, a floor care apparatus has a housing with a wall having a contour. A thin, flexible membrane circuit includes an adhesive side that attaches the circuit to the wall to generally follow the contour. In this manner, mechanical fasteners are avoided as are the manufacturing complexities surrounding fastener installation and design of fastener receptacles. Because of its relative thinness, the circuit also eliminates needing abundant space in the cleaner. A processor or a controller, embodied as discrete components, software, processor, microprocessor, firmware, combinations, etc. connects to the circuit and illuminates a visual indicator as a relative function of the cleanliness or dirtiness of an airstream related to a signal of a dirt sensor connected to the controller. A motor is also controlled by the controller as a relative function of the dirt sensor signal.

In other embodiments, the flexible membrane circuit includes a side opposite the adhesive side to friction fit the visual indicator against the housing. This keeps the indicator fixed in place during use.

In still other embodiments, the visual indicator representatively includes a plurality of colors, from light emitting diodes, illuminated by the controller to indicate transitions in suctioned airstream cleanliness to dirtiness, and vice versa. It also dually indicates changes in motor speed from suction relatively low to suction relatively high, and vice versa. The side opposite the adhesive side of the circuit is that which connects to the light emitting diodes.

In the following description there is shown and described possible embodiments of the invention, simply by way of illustration of one of the modes best suited to carry out the invention. As it will be realized, the invention is capable of other different embodiments, and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated in and forming a part of the specification, illustrate several aspects of the present invention, and together with the description serves to explain the principles of the invention. In the drawings.

DETAILED DESCRIPTION OF THE INVENTION

Figure 1:
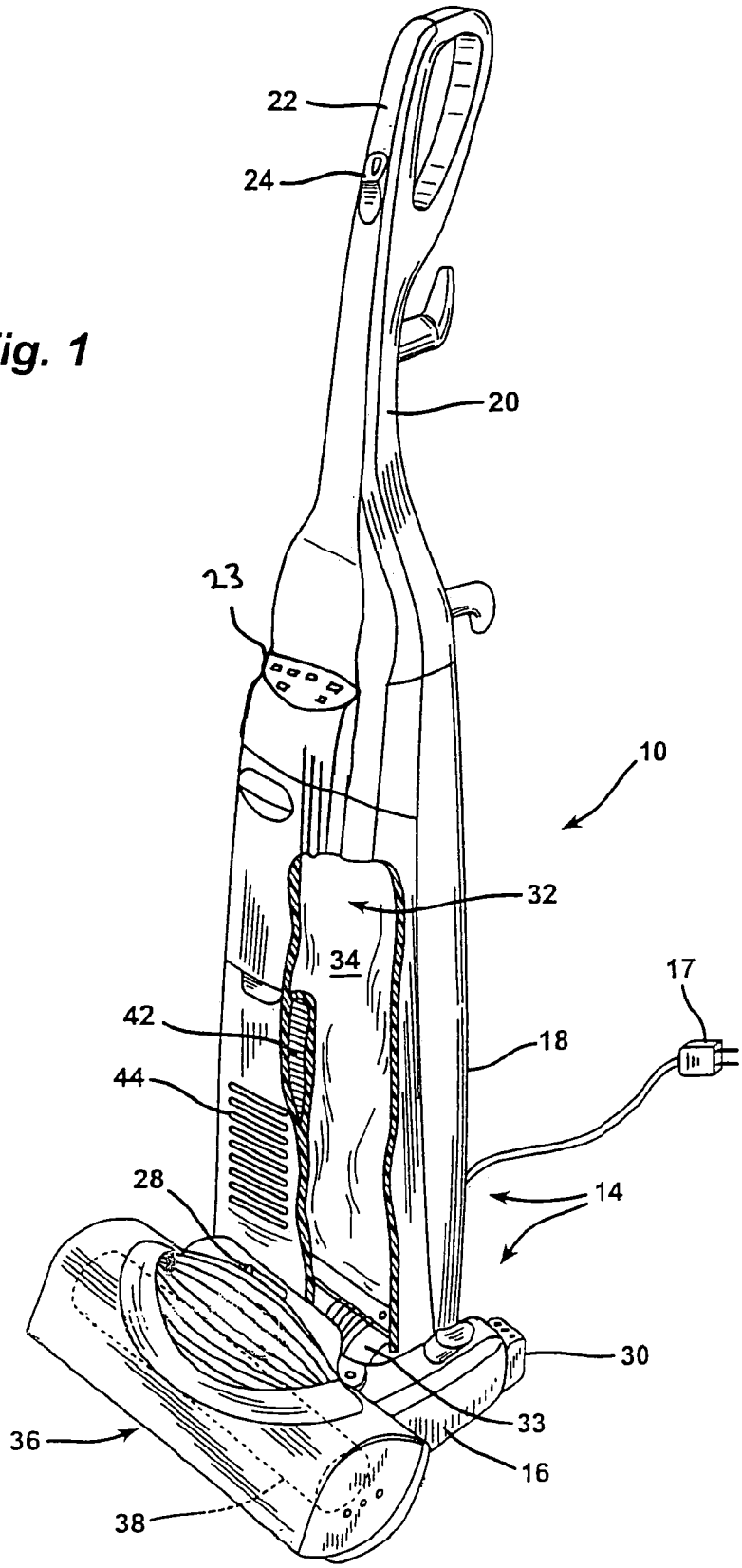
FIG. 1 is a perspective view of a floor care apparatus, in this instance an upright vacuum cleaner, constructed in accordance with the teachings of the present invention.

Reference is now made to FIG. 1 showing a floor care apparatus of the present invention. The apparatus illustrated exemplifies an upright vacuum cleaner 10 comprised generally of a housing 14 that comprises the nozzle assembly 16 and the canister assembly 18. The canister assembly 18 further includes the handle 20 and the hand grip 22 for maneuvering the cleaner during use. The hand grip 22 carries a control switch 24 for turning the vacuum cleaner 10 on and off while electrical power is supplied from a standard electrical wall outlet through a cord and plug assembly 17. The handle 20, among other things, carries a visual indicator 23 of sorts to indicate a relative cleanliness or dirtiness of a suctioned airstream in the cleaner and/or motor speed, in response to same, as will be described below. At the lower portion of the canister assembly 18, rear wheels (not shown)

are provided to support the weight of the vacuum cleaner 10. A second set of wheels (not shown) allow the operator to raise and lower the nozzle assembly 16 through selective manipulation of a height adjustment switch 28. To allow for convenient storage of the vacuum cleaner 10, a foot latch 30 functions to lock the canister assembly 18 in an upright position, as shown in FIG. 1. When the foot latch 30 is released, the canister assembly 18 may be pivoted relative to the nozzle assembly 16 as the vacuum cleaner 10 is manipulated to clean the floor.

Also, the canister assembly 18 carries an internal chamber 32 that houses a suction fan motor 33 (i.e. a state of the art fan and motor combination) and a dust bag 34 for removing dirt or dust entrained in the airstream as it passes in an airflow path from the nozzle assembly 16 to the suction fan motor. During use, the suction fan motor 33 creates the suction airflow in a well known manner. Alternatively, the dust bag is replaceable with a dust cup externally visible to the cleaner that operators empty upon visible inspection.

In the nozzle assembly 16, a nozzle and agitator cavity 36 houses an agitator 38. The rotary scrubbing action of the agitator 38 and the negative air pressure created by the suction fan motor 33 cooperate to brush and beat dirt and dust from the nap of the carpet being cleaned and then draw the dirt and dust laden air from the agitator cavity 36 to the dust bag 34. Specifically, the dirt and dust laden air passes serially through a suction inlet and hose (not shown) and/or an integrally molded conduit in the nozzle assembly 16 and/or canister assembly 18 as is known in the art. Next, it is delivered into the chamber 32 where it passes through the porous walls of the dust bag 34. The bag 34 serves to trap the suspended dirt, dust and other particles inside while allowing the now clean air to pass freely through the wall thereof. Clean air then flows through the suction fan motor 33, final filtration cartridge 42 and, ultimately, to the environment through the exhaust port 44.

Figure 2:
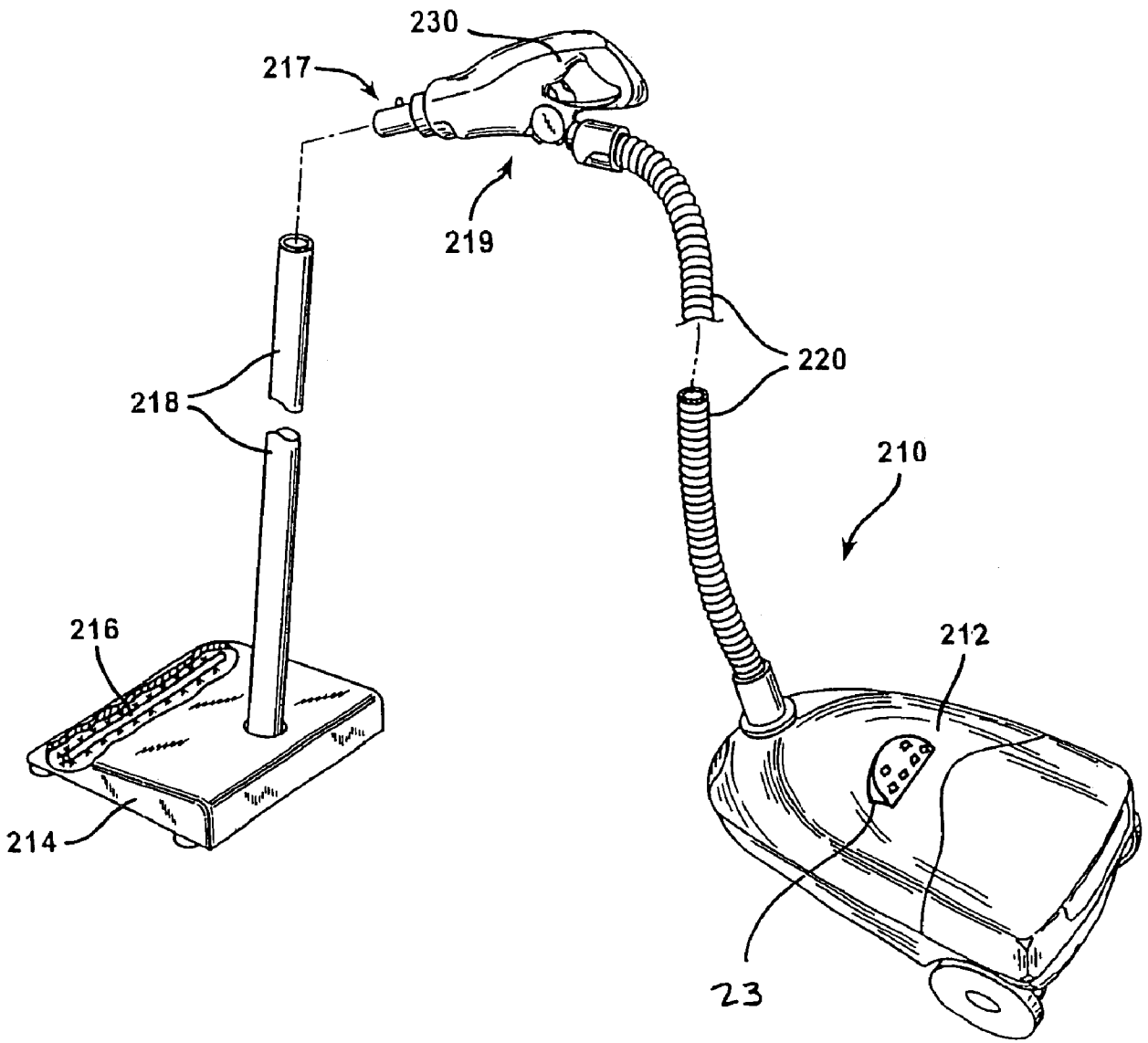
FIG. 2 is a perspective view of a floor care apparatus, in this instance a canister vacuum cleaner, constructed in accordance with the teachings of the present invention.

With reference to FIG. 2, a floor care apparatus of the present invention in this embodiment exemplifies a canister vacuum cleaner 210 with a housing comprised generally of a base assembly 212 and a nozzle assembly 214. Although not shown, the base assembly contains a suction fan motor that cooperates with an agitator 216 in the nozzle assembly for sucking up dirt and dust in the manner previously described for the upright cleaner. A wand 218 mechanically and fluidly connects to the nozzle assembly and facilitates the sucking up of dirt and dust. In various embodiments, it comprises a unitary, telescopic or connecting section of pipe. Near the base assembly, a hose 220, flexible for user manipulation, connects thereto and likewise facilitates cleaning. Finally, a handle 230 having ends 217, 219 connects mechanically and fluidly to both the wand 18 and the hose 220 and enables an airflow path between the nozzle assembly and the suction fan motor of the base assembly. A visual indicator 23 also exists and provides users indication regarding the relative cleanliness or dirtiness of a suctioned airstream in the cleaner, and/or motor speed, in response to same, as will be described below.

In either floor care apparatus embodiment, the visual indicator preferably embodies a plurality of colors, from light emitting diodes, illuminated by signals from a connected controller to indicate transitions in a suctioned airstream from cleanliness to dirtiness, and vice versa. It also dually indicates changes in motor speed from suction relatively low to suction relatively high, and vice versa. In a representative embodiment, the visual indicator 23 of FIG. 3 includes a plurality of serially arranged lenses 310-1, 310-2, 310-3, 310-4 and one or more other lenses 312, 314 on the cleaner housing 14 (alternatively 212). Underneath the lenses, a plurality of light emitting diodes (LED's) reside that illuminate or not to visually indicate to users the revolutions of the cleaner motor as a function of dirt flow in an airstream suctioned elsewhere in the cleaner. Namely, one red, two amber and two green LED's are provided and illuminate as follows: one or both of the two green LED's 310-4, 312 illuminate to indicate a relatively clean airflow and a correspondingly low motor speed; one or both of the Amber LED's 310-2, 310-3 illuminate to indicate a moderately dirty airflow and a correspondingly medium motor speed; and the red LED 310-1 illuminates to indicate a very dirty airflow and a correspondingly high motor speed. In this regard, users can continually operate the cleaner in areas requiring more suctioning and operate the cleaner less in other areas requiring less suctioning. Intuitively, this will save the cleaned undersurface from overdue vacuum suctioning and mechanical scrubbing if the surface is relative clean and the green LED's are illuminated. Also, the serial arrangement of the lenses provides functionality in users being able to visualize the ramping-up/down of the motor speed for dirty/clean airstreams. The remaining lens 314 may also include an underlying LED of any or multiple colors and it could provide still other indications as necessary. Of course, skilled artisans can contemplate other embodiments, lens layout, color schema, and the like and all are embraced by the invention.

Electrically and mechanically connected to the visual indicator is a flexible membrane circuit that interfaces with a controller for lighting or illuminating the variously colored LED's. As will become apparent, the flexible membrane circuit connects at one end to the LED's, including or not a friction fit, and at the other to the controller via a connector. In this manner, the flexible circuitry of the membrane replaces previously utilized printed circuit board (PCB) technology (and their attendant wires) that, in turn, allows for easier manufacturing, e.g., no screws, applied via an adhesive that can generally follow any wall contours of the housing. Its relative thinness also eliminates the need for designing bulk spaces in the housing.

Figure 3:
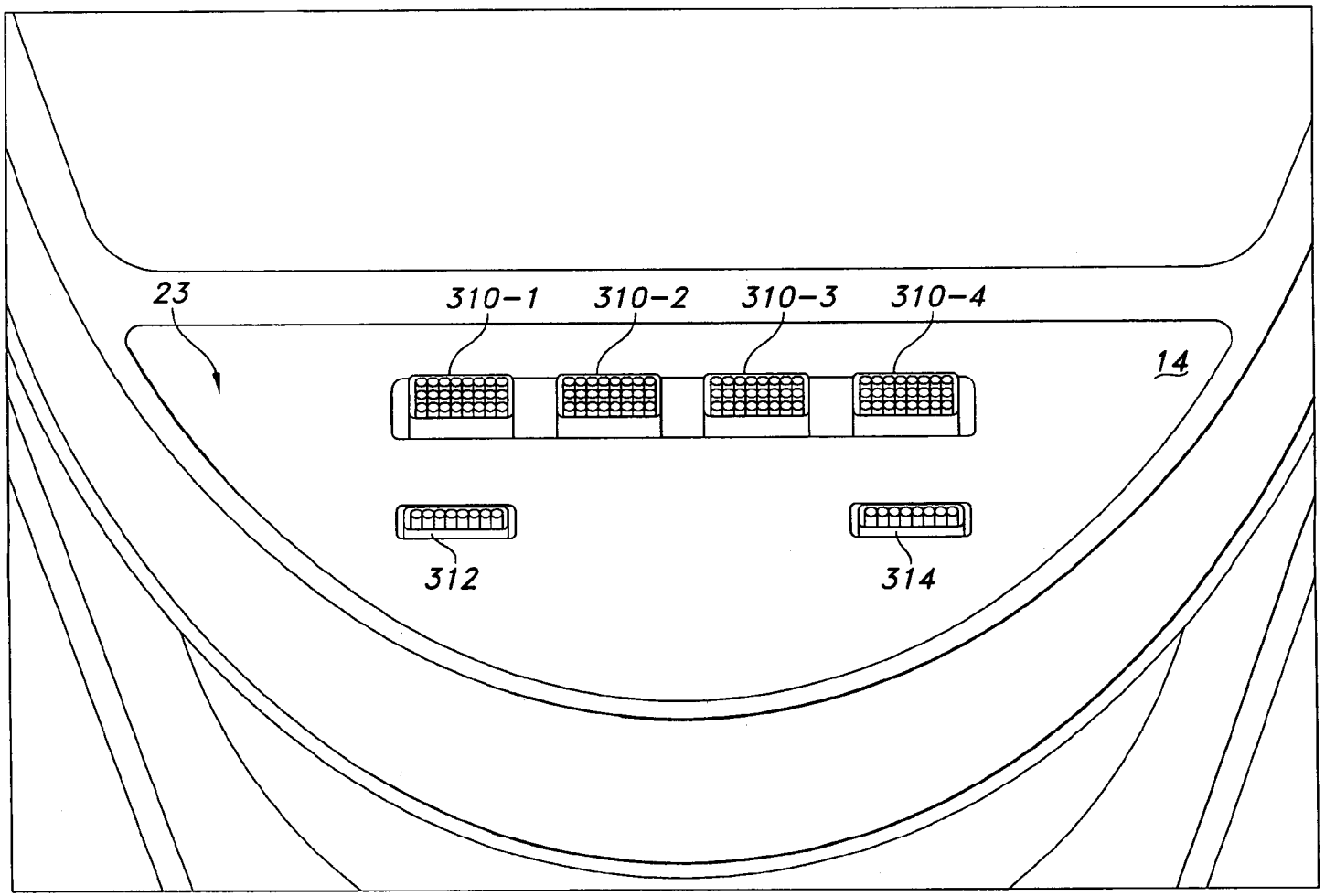
FIG. 3 is a diagrammatic view of a representative visual indicator.
Figure 4:
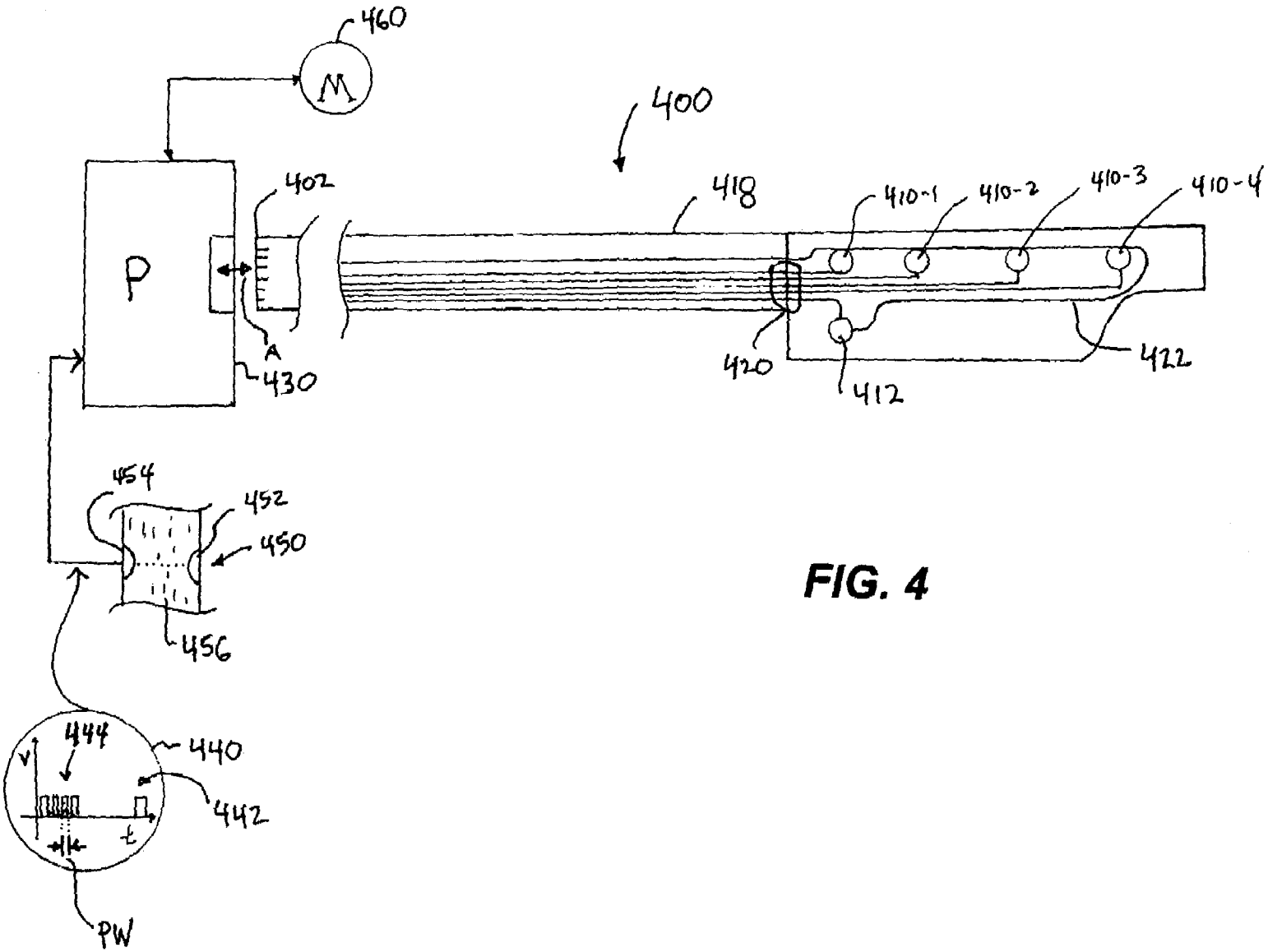
FIG. 4 is a diagrammatic and circuit view of the visual indicator that shows the relative dirtiness or cleanliness of an airstream in a floor care apparatus.
Figure 7:
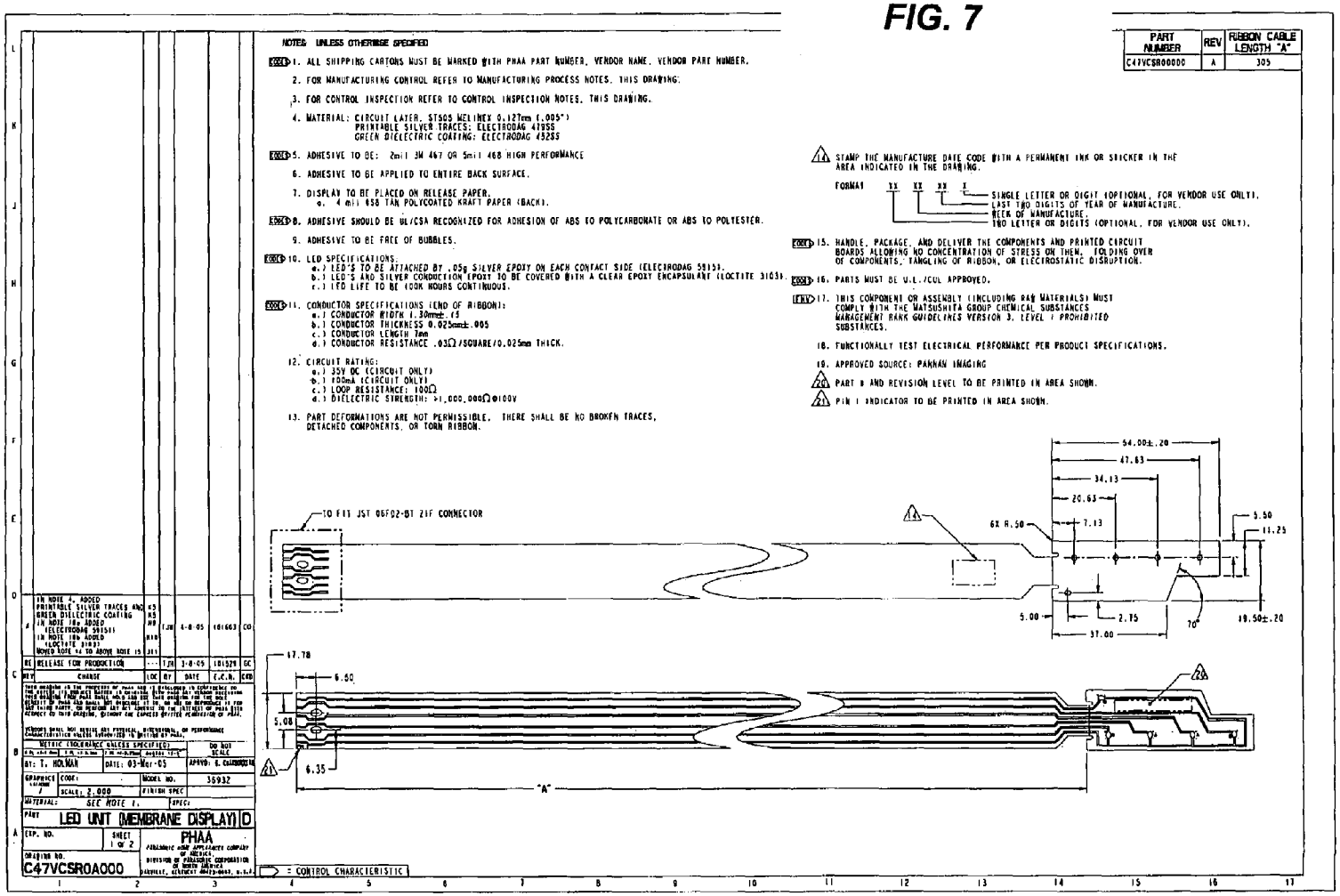
FIG. 7 is a specification for a representative flexible membrane circuit of the invention.

With more specificity, FIG. 4 teaches a flexible membrane circuit 400 including a first terminal end with a connector 402 and a second terminal end with a plurality of LED's 410-1, 410-2, 410-3, 410-4 and 412 for insertion underneath the lenses 310-1, 310-2, 310-3, 310-4 and 312 of FIG. 3, respectively. Between the connector and LED's resides a sufficient length of thin, connector material 418 to communicate electrically from the connector to the LED's. In this regard, the material 418 includes the specifications listed in FIG. 7. Referring back to FIG. 4, representative wiring of the circuit includes one or more electrical conductors 420 connecting individual LED's to a positive side thereof and to a common ground wire 422 from their respective negative sides. Various thin film or other coatings, such as dielectrics, are also contemplated for electrical isolation and robustness.

At the connector end of the circuit, the connector 402 attaches to a controller or processor P 430 as indicated by the action arrow A. In this regard, the controller or processor can be a microprocessor, of sorts, embodied as an ASIC, a plurality of discrete components, software, firmware or combinations thereof. In function, however, it receives an input signal 440 from a dirt sensor 450 to drive a suction motor, M, 460 (alternatively motor 33, FIG. 1) and illuminate the visual indicator 23 (FIGS. 1-3) in response to the input signal from the dirt sensor.

In one embodiment, the design includes a single light transmitter 452 and receiver 454 pair arranged across a suction channel 456 in a cleaner. During use, it detects the presence, absence and/or volume of dirt particles flowing in the channel by the amount of light received at the receiver 454. In general, the more light, the less dirt. Graphically, 442 shows a portion of a signal with relatively little dirt while 444 shows a portion of the signal with relatively high amounts of dirt. In turn, the motor 460 is driven relatively low or slowly in response to the little dirt portion 442 of the signal and relatively high or fast in response to the dirty portion 444 of the signal. In other words, more dirt in the channel 456 means a faster motor speed. Conversely, less dirt means a slower motor speed. Likewise, fast or high motor speed means illumination of LED 410-1 while slow or low motor speed means illumination of one or both of LED's 410-4 and 412. In between, one or both of the amber LED's 410-2, 410-3 are illuminated. It is also expected to drive the illumination of the LED's to indicate the relative cleanliness or dirtiness of the airstream in the channel 456 such that the LED's will real-time continuously flicker between glow brightly, glow slightly or glow not-at-all conditions at every instance of time according to the relative cleanliness of the airflow. Although not shown, triacs and various other traditional components, such as resistors and transistors, are present in the design to achieve the proper signal levels in the circuit.

With further processor 430 specificity, it is contemplated that control of motor speed will occur when it is adjudicated that a sufficient number of valid particles have passed the dirt sensor 450 during a given 100 millisecond interval and that other dirt particles, despite their on time or registration of an amplitude on a voltage axis of a voltage versus time graph, can be generally ignored. In this regard, dirt particles greater than 10 micrometers are deemed worthy of being a valid dirt particle. In turn, based on the speed of suction, these particles are known to cause a certain pulse width PW at the light receiver 454 of the dirt sensor 450. When a sufficient number of valid dirt particles are seen over a 100 millisecond interval (including or not invalid particles also flowing in the dirt stream), the motor is adjudicated as needing an increase in motor speed and motor speed is increased. (Naturally, this assumes the motor is not already running at its highest speed. As of today, the four possible motor speed settings include high, medium high, medium and low. Motor speed adjustments also occur for 2.5 second periods.) Conversely, if only invalid particles are seen over this 100 millisecond interval or too few valid particles are seen (including or not invalid particles in the dirt stream), no speed increase correction to the motor is implemented. Yet, the invalid particles themselves have an on-time or detection time during the 100 millisecond interval as do the "too few" valid particles. However, these on-times or working times relative to the 100 millisecond interval are wholly disregarded. By ignoring these times, a duty cycle of the total particle detection time to the overall time is not necessarily required to be calculated. Conversely, a speed decrease correction to the motor may occur during times of only invalid dirt particles or too few valid particles. (This assumes, of course, the motor is not already running at is lowest speed.) However, this is figured in the same manner as before, i.e., by assessing whether a sufficient number of valid particles have passed the sensor, and the "working times" of the invalid particles and the too few valid particles are still ignored. In either event, it is especially convenient that the motor 460 is not adjusted as a function of duty cycle.

Figure 5:
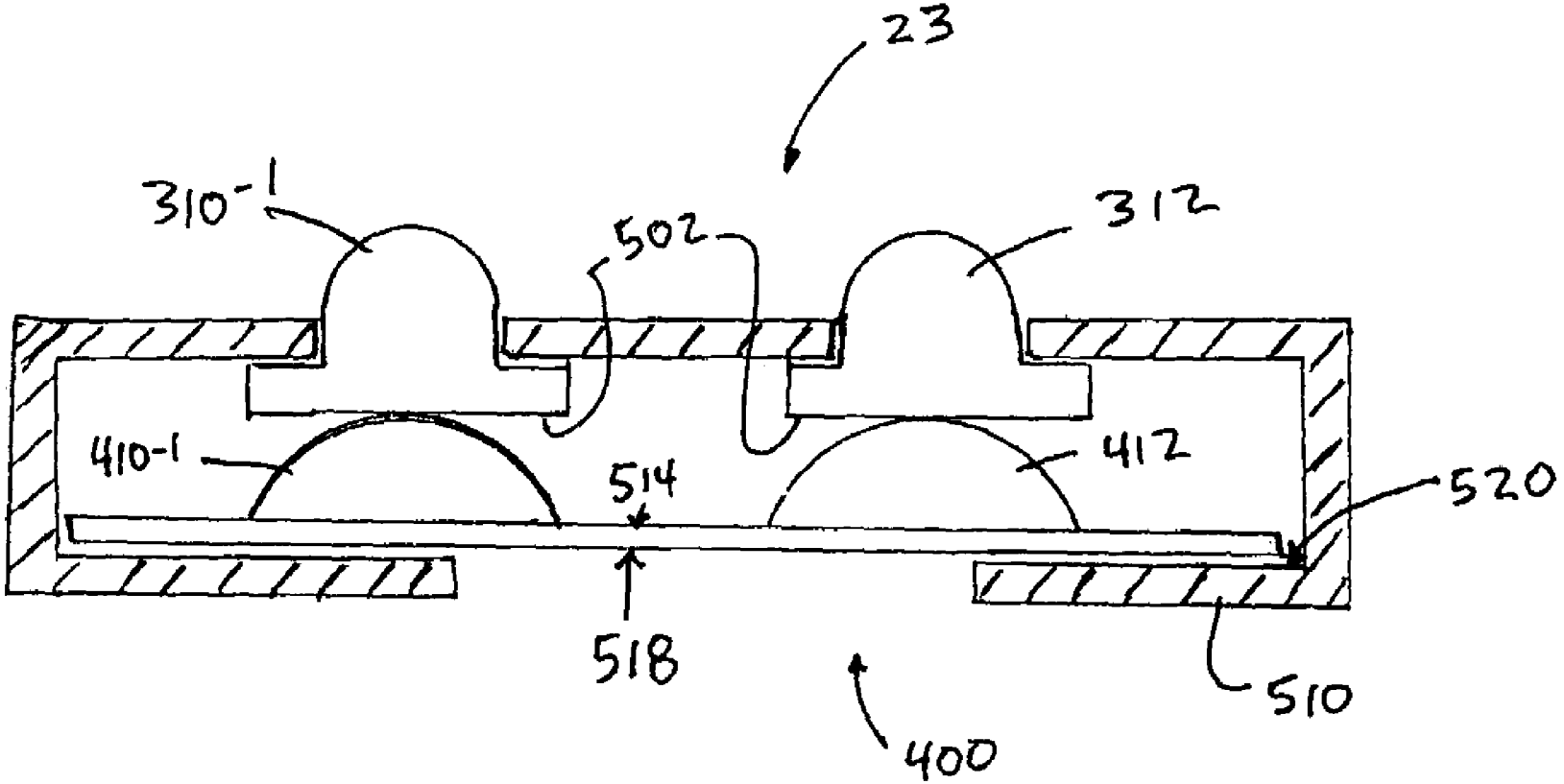
FIG. 5 is a diagrammatic view of a more detailed embodiment of the visual indicator.

In FIG. 5, a representative cross section of the visual indicator 23 and underlying flexible membrane circuit 400 is given. As seen, LED's 410-1 and 412 abut an undersurface 502 of the lenses 310-1 and 312. They do so because of the friction fit arrangement of the flexible membrane circuit relative to a wall 510 of the housing. Namely, the size and space constraints of the wall are adjusted such that the undersurface of the lenses, the LED's relative height and membrane circuit thickness all fit tightly. In turn, this keeps the visual indicator in place on the cleaner. It also eliminates the use of mechanical fasteners. Even further, the flexible membrane circuit includes first and second sides 514, 518. On the first side, the LED's reside and are electrically contacted. On the side opposite this, or the second side 518, an adhesive layer exists. Preferably, the adhesive embodies epoxies, glues or the like for attaching securely to materials, especially plastic, of cleaner housings. Also, the adhesive enables the flexible membrane circuit to generally follow the contour 520 of the wall regardless of the shape, length, contortion, surface texture, etc. of the wall. In this manner, the flexible membrane circuit of the invention serves to connect a controller to a visual indicator regardless of relative locations and distance between the controller and visual indicator and without concern for large bulk space areas in the housing or need for mechanical fasteners/fastener receptacles. As is appreciated, this represents an enormous advance over the prior art.

Figure 6:
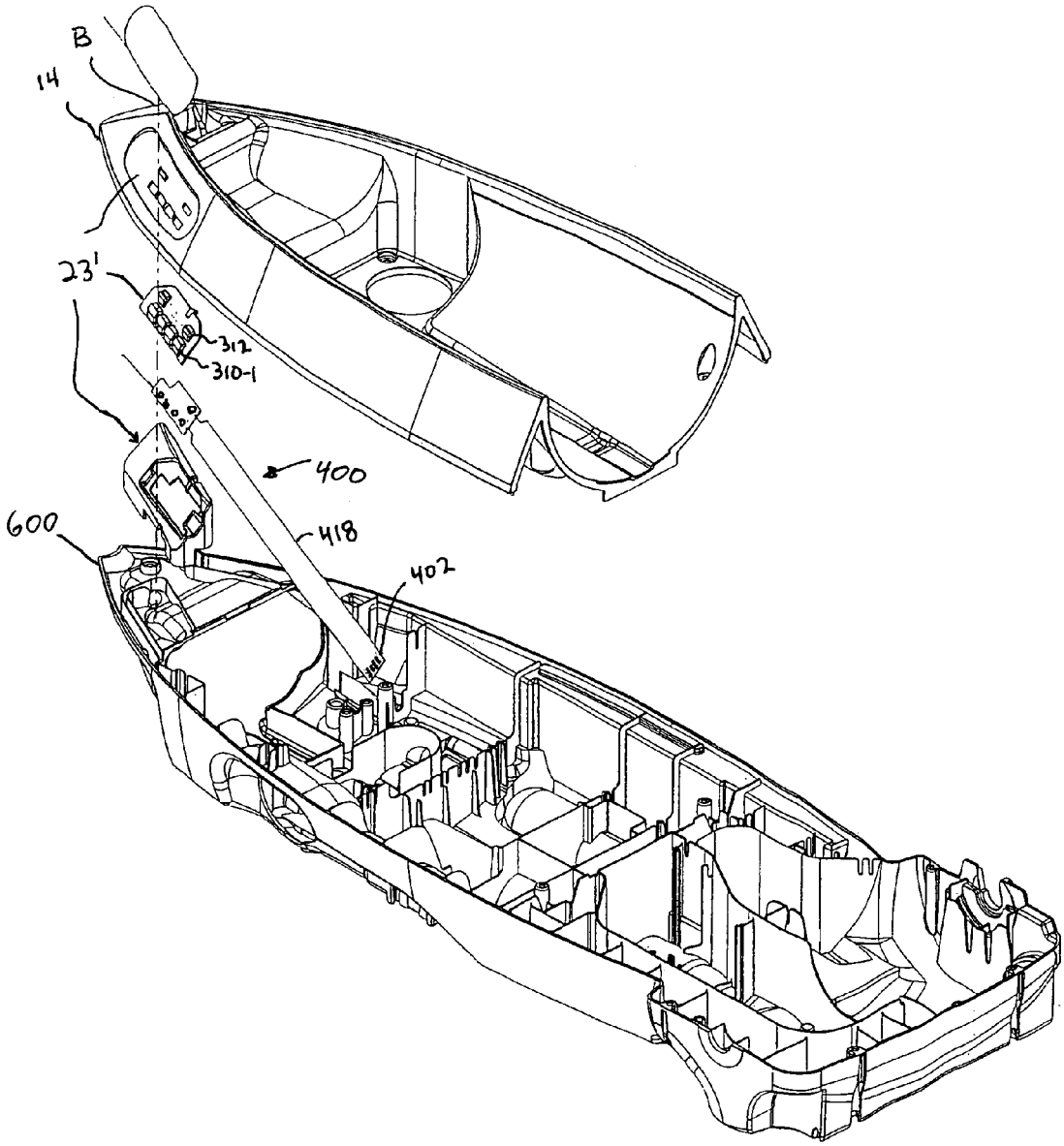
FIG. 6 is an exploded diagrammatic view of a representative visual indicator and flexible membrane circuit for a floor care apparatus.

With reference to FIG. 6, an exploded view of a representative flexible membrane circuit 400 and portions 23' of a visual indicator on a floor care apparatus 600 is given. In this regard, skilled artisans will observe the relative ease by which the foregoing can be assembled with very little, if any, need for mechanical fasteners/fastener receptacles and bulk spaces. Sandwiching the parts is also contemplated along the length of the given dashed line B with snap-locking parts and a flexible membrane circuit insertable underneath the lenses of the visual indicator to achieve a friction fit design as previously mentioned.

The foregoing was chosen and described to provide the best illustration of the principles of the invention and its practical application to thereby enable one of ordinary skill in the art to utilize the invention in various embodiments and with various modifications as are suited to the particular use contemplated. All such modifications and variations, including combinations of one or more of the foregoing individual embodiments, are within the scope of the invention as determined by the appended claims when interpreted in accordance with the breadth to which they are fairly, legally and equitably entitled.

The invention claimed is:

1. A floor care apparatus, comprising:

a housing having a wall with a contour;

a visual indicator on the housing, the visual indicator having a plurality of serially arranged lenses;

a controller in the housing; and a flexible membrane circuit electrically connecting the visual indicator and the controller, the circuit including a first and second side, the first side friction fits a portion of the visual indicator against the housing, the second side including an adhesive to attach the second side to the wall to generally follow the contour.

2. The floor care apparatus of claim 1, further including a dirt sensor providing an input to the controller.

3. The floor care apparatus of claim 2, wherein the visual indicator includes a plurality of light emitting diodes having various colors located underneath the lenses to indicate a relative dirtiness or cleanliness of an airstream related to the input of the dirt sensor.

4. The floor care apparatus of claim 3, wherein the first side of the circuit connects to the light emitting diodes.

5. The floor care apparatus of claim 2, wherein the controller includes a control for a motor as a relative function of the input of the dirt sensor.

6. The floor care apparatus of claim 5, wherein the controller controls illumination of the visual indicator via the circuit as a relative function of a speed of the motor.

7. The floor care apparatus of claim 2, wherein the controller controls illumination of the visual indicator via the circuit as a relative function of the input of the dirt sensor.

8. A floor care apparatus, comprising:

a housing;

a controller in the housing;

a dirt sensor providing an input to the controller;

a visual indicator on the housing having a plurality of lenses, the controller controlling illumination of the visual indicator as a relative function of the input of the dirt sensor; and a flexible membrane circuit electrically connecting the visual indicator and the controller, the circuit having a first terminal end with a connector and a second terminal end with a plurality of light emitting diodes for insertion underneath the lenses.

9. The floor care apparatus of claim 8, wherein the housing further includes a wall having a contour.

10. The floor care apparatus of claim 9, the circuit including a first and second side, the first side of the circuit friction fits a portion of the visual indicator against the housing and connects to the light emitting diodes such that the light emitting diodes abut an undersurface of the lenses whereby the need for mechanical fasteners is eliminated, the second side including an adhesive to attach the second side to the wall to generally follow the contour.

11. The floor care apparatus of claim 10, wherein the controller further includes a control for a motor as a relative function of the input of the dirt sensor.

12. A floor care apparatus, comprising:

a housing with a wall having a contour;

a controller in the housing;

a dirt sensor providing an input to the controller;

a motor controlled by the controller as a relative function of the input of the dirt sensor;

a visual indicator on the housing, the controller controlling illumination of the visual indicator as a relative function of the input of the dirt sensor; and a flexible membrane circuit electrically connecting the visual indicator and the controller, the circuit including a first and second side, the second side including an adhesive to attach the second side to the wall to generally follow the contour.

13. The floor care apparatus of claim 12, wherein the visual indicator includes a plurality of colors to indicate a relative dirtiness or cleanliness of an airstream related to the input of the dirt sensor.

14. The floor care apparatus of claim 12, wherein the visual indicator includes a plurality of light emitting diodes.

15. The floor care apparatus of claim 14, wherein the first side of the circuit connects to the plurality of light emitting diodes.

16. The floor care apparatus of claim 12, wherein the circuit friction fits a portion of the visual indicator to the housing.

17. A method of making a floor care apparatus, comprising:

providing a housing with a wall having a contour; and attaching a flexible membrane circuit to the housing by adhering a side of the circuit to the wall to follow the contour.

18. The method of claim 17, further including connecting the circuit to a controller and a visual indicator.

19. The method of claim 18, further including connecting the controller to a dirt sensor in the housing so during use the controller can control illumination of the visual indicator via the circuit as a function of the dirtiness or cleanliness of an airstream related to a signal of the dirt sensor.

20. The method of claim 19, further including connecting the controller to a motor so during use the controller can control motor speed based upon the number of dirt particles greater than 10 micrometers that pass the dirt sensor during a given 100 millisecond interval.

* * * * *